US006142317A

United States Patent [19]

Merl

[11] Patent Number: 6,142,317

[45] Date of Patent: Nov. 7, 2000

[54] GRAVITY FEED SHELVING SYSTEM WITH TRACK AND PUSHER

[76] Inventor: Milton J. Merl, 267 W. 70th St., New York, N.Y. 10023

[21] Appl. No.: 09/156,483

[22] Filed: Sep. 18, 1998

Related U.S. Application Data

[63] Continuation-in-part of application No. 08/968,285, Nov. 12, 1997, abandoned.

[51] Int. Cl.[7] ..... A47F 1/12; A47F 5/10

[52] U.S. Cl. ..... 211/59.3; 211/184

[58] Field of Search ..... 211/59.3, 59.2, 211/184

[56] References Cited

U.S. PATENT DOCUMENTS

| | | | |
|---|---|---|---|
| 3,780,873 | 12/1973 | Silva | 211/59.3 |
| 4,351,439 | 9/1982 | Taylor | 211/59.3 |
| 4,386,710 | 6/1983 | Dauman | 211/59.3 |
| 4,416,380 | 11/1983 | Flum | 211/59.2 |
| 4,750,743 | 6/1988 | Nicoletti | 211/51 X |
| 4,762,235 | 8/1988 | Howard et al. | 211/59.3 |
| 4,899,893 | 2/1990 | Robertson | 211/59.3 |
| 4,901,869 | 2/1990 | Hawkinson et al. | 211/59.3 |
| 5,088,607 | 2/1992 | Risafi et al. | 211/59.3 |
| 5,111,942 | 5/1992 | Bernardin | 211/59.3 |
| 5,390,802 | 2/1995 | Pappagallo et al. | 211/59.3 |
| 5,505,315 | 4/1996 | Carroll | 211/59.3 X |
| 5,562,217 | 10/1996 | Salveson et al. | 211/59.3 |
| 5,638,963 | 6/1997 | Finnelly et al. | 211/59.3 |
| 5,673,801 | 10/1997 | Markson | 211/59.3 |
| 5,685,664 | 11/1997 | Parham et al. | 211/59.3 X |
| 5,833,076 | 11/1998 | Harres et al. | 211/51 |

*Primary Examiner*—Daniel P. Stodola
*Assistant Examiner*—Erica B. Harris
*Attorney, Agent, or Firm*—Schweitzer Cornman Gross & Bondell LLP

[57] ABSTRACT

An apparatus for the display and storage of package products in a store environment for access by consumers is adapted for use in conjunction with conventional display gondolas having uprights for shelf mounting. The apparatus includes a gravity feed unit for positioning on a shelf behind an array of products to drive the products forward on the shelf towards a bumper unit. A track for guiding the gravity feed unit slopes downwardly towards the front of the shelf, allowing a force to be generated by the pusher unit against the arrayed products. The pusher may have a platform on which products may be placed to increase the effective mass of the pusher to enhance the produced forward force.

27 Claims, 9 Drawing Sheets

32
58
130
132
62
136
134
138
132
140
78
126
94
66
102
60
64
122
96
92
56
110
108
106
112
8
104
162
160
128
120
116
112
118
120
102
162
8

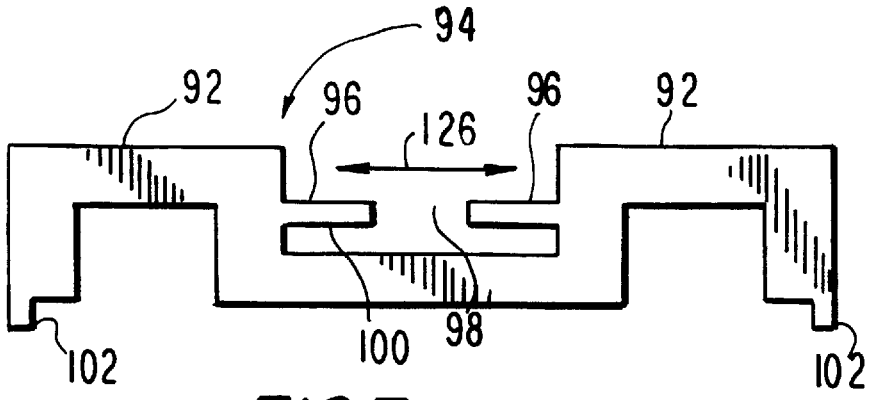
FIG. 7
FIG. 8
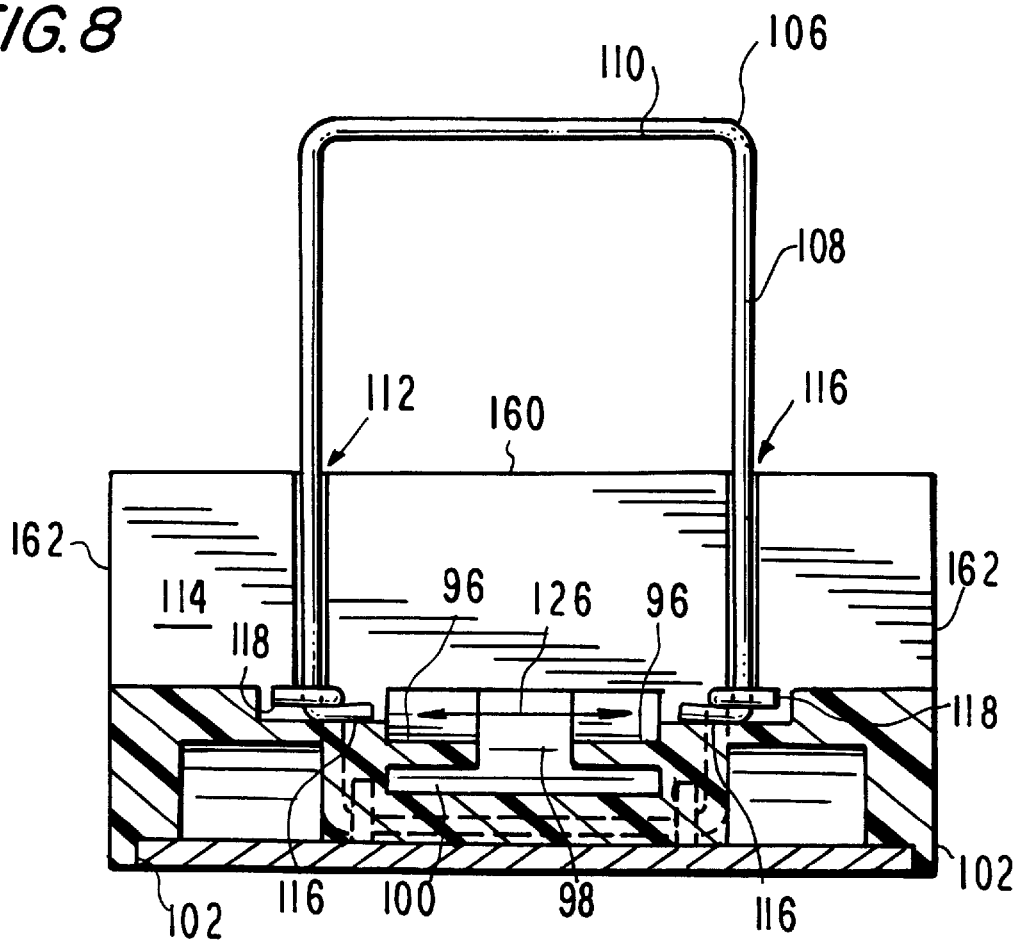

GRAVITY FEED SHELVING SYSTEM WITH TRACK AND PUSHER

The present invention relates to a new and improved shelf system, as used in retail store establishments, for the storage and display for sale of products, and particularly packaged products. This application is a continuation-in-part of U.S. patent application Ser. No. 08/968,285, filed Nov. 12, 1997, now abandoned.

BACKGROUND OF THE INVENTION

Commercial retail sales establishments, as exemplified by grocery stores and the like, offer for sale an ever-increasing variety of products packaged in a correspondingly increasing diversity of packaging. Bags, boxes and pouches of ever-increasing diversity are being formulated to contain and protect the packaged contents, as well as to display and present them in an aesthetically pleasing manner.

Conventional shelf systems are typically unsuited for effective merchandising of such a variety of products. A typical shelf assembly consists of a horizontal shelf panel, which may be either solid or formed of a wire grid, supported by one or more horizontal brackets which are mounted at their rear ends to uprights in the shelf-supporting gondolas of the store. The shelves may be provided with pre-marked or segmented areas extending the depth of the shelf to allow dividers to be mounted thereon. Limited flexibility in product arrangement is provided by such shelving. In addition, access to the rear of a shelf is often difficult, both for inventory and stocking purposes as well as for product selection by the consumer. Typically, the product at the front of the shelf is removed first, making each subsequent purchase more difficult, both from the point of view of product accessibility as well as product visibility on the shelf.

In addition, and particularly when products are packaged in pouches or bags, while a pleasing and space-efficient array of the products can be made when the products are first placed on the shelves, subsequent removal of product disrupts the array, causing products to fall or otherwise become disorganized, further making product identification and selection difficult and decreasing the aesthetic appeal and thus the marketability of the products.

It is accordingly a purpose of the present invention to provide a new and improved shelf structure for the effective presentation of products.

Another purpose of the present invention is to provide a shelf system which is capable of segmentation and division to accommodate a variety of differently-shaped products.

Still another purpose of the present invention is to provide a shelf system capable of maintaining products in a pleasing arrangement and towards the forward end of the shelf for optimum visibility and availability.

Yet a further purpose of the present invention is to provide a shelf system which is of a modular type, adaptable to a variety of shelf depths and widths, and which can allow for the segmenting and separation of a plurality of different sized products across a shelf.

A still further purpose of the present invention is to provide a shelf system of the aforementioned type which is of efficient and economical construction having ease of assembly and use.

BRIEF DESCRIPTION OF THE INVENTION

The present invention encompasses an apparatus for maintaining products in an orderly aligned arrangement towards the forward end of a shelf, as well as a shelf construction incorporating such an apparatus. The apparatus for maintaining the products includes a pusher unit which is located at the back of the column of product, and which exerts, under the influence of gravity, a forwardly-directed force against the products, maintaining them towards the forward edge of the shelf and pressing the products gently together to eliminate any spaces therebetween which may result when one of the aligned products is removed. The pusher is directed forward by a downward back-to-front tilt of the shelf upon which the pusher is placed.

A product retainer bumper is located at the front edge of the shelf, at the forward end of the path of the pusher, and may include an upwardly-extending forward lip, to maintain the products in front of the pusher and prevent them from falling off the front edge of the shelf. To further maintain the products in line between the pusher and bumper dividers may be mounted between adjacent product columns.

The pusher and bumper may form a part of an integrated product gravity feed and display unit, which is adapted to support and display an aligned column of products extending between the front and rear of the shelf, and which may be arrayed across the length of a shelf. Each gravity feed and display unit includes a track member upon which the products are placed, the track extending the depth of the shelf and terminating at its forward end in a bumper. The pusher is located upon, and travels along, the track, behind the products, urging them forward.

A shelf system constructed in accordance with the present invention may further include a shelf frame which is mountable upon the uprights of a conventional store shelf gondola construction. The shelf frame may comprise a pair of brackets mounted to the uprights, as well as a series of shelf rails extending between the brackets. The gravity feed and product display units may be mounted upon the rails in conjunction with the dividers, thus eliminating the need for an additional shelf surface.

Alternatively, the shelf system may incorporate a shelf surface formed of a wire grid construction, the grid wires extending the depth of the shelf. With such a shelf the pusher may ride directly upon the shelf surface, the bumper being mounted to the grid at the forward edge of the shelf.

BRIEF DESCRIPTION OF THE DRAWINGS

A fuller understanding of the present invention will be obtained upon review of the following detailed description of an illustrative embodiment thereof, when considered in connection with the annexed drawings, wherein:

FIG. 7 is a rear elevation view of a gravity feed and display unit track;

FIG. 8 is a section view of the bumper portion of a gravity feed and display unit, taken along line 8—8 of FIG. 3;

DETAILED DESCRIPTION OF THE INVENTION

Figure 1:
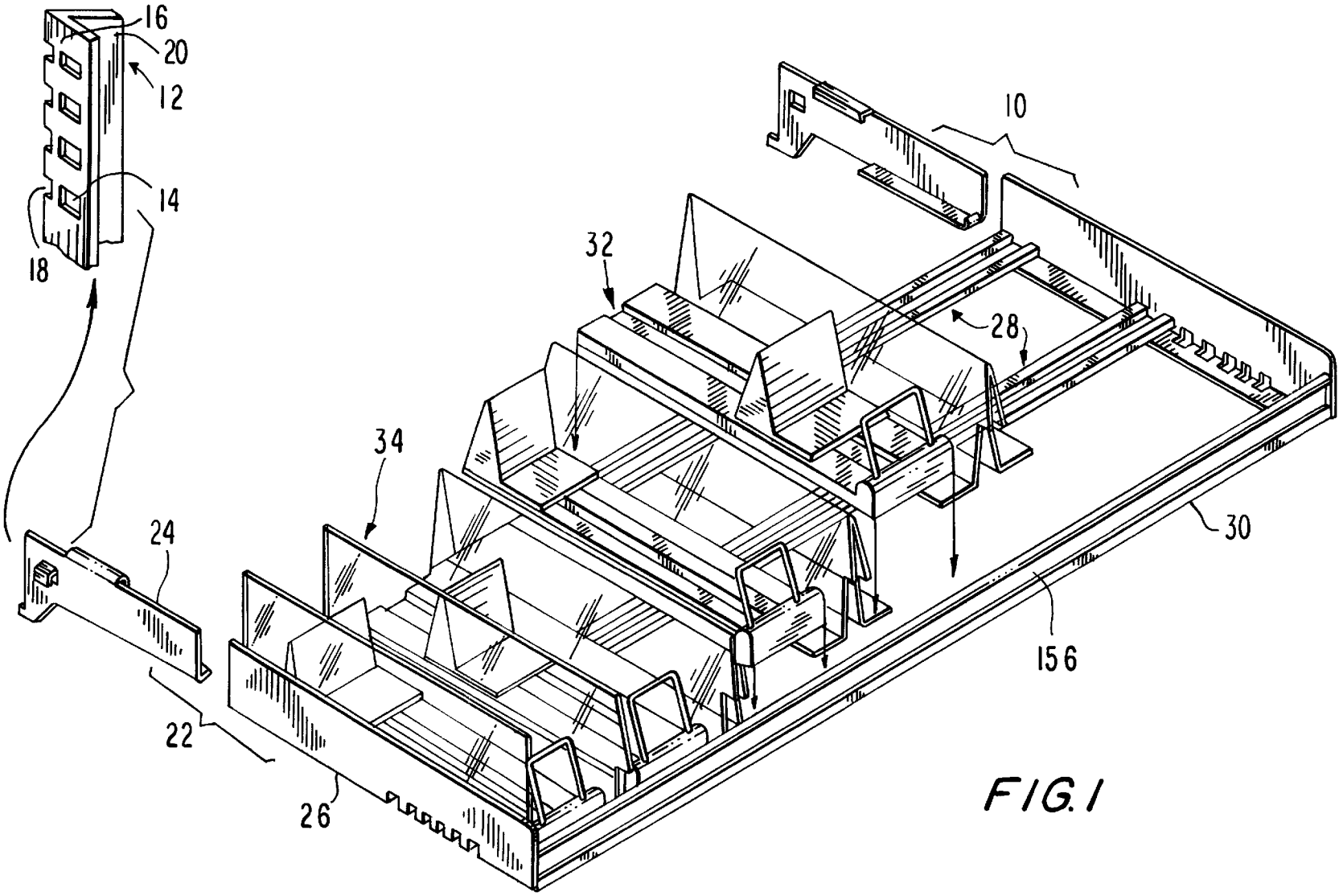
FIG. 1 is a perspective view, partially exploded, of a shelf system of the present invention.

Referring initially to FIG. 1, a shelving system 10 of the present invention is intended to mount to uprights 12 of a type which may be utilized in connection with conventional store gondola constructions. As shown, such uprights may comprise a right angle beam having a plurality of first slots 14 through first wall 16 and a second plurality of slots 18 through both first wall 16 and extending into second wall 20 from the corner of the upright. Shelf system 10 includes a pair of right and left side bracket assemblies 22, each comprising a mounting bracket 24 adapted to connect with an upright 12, and a shelf support bracket 26, which connects to the mounting bracket 24, as will be explained infra, in an adjustable manner allowing for adjustment of overall length of the bracket assembly and thus the depth of the shelf area upon which the pushers and bumpers are mounted. As depicted in FIG. 1, the shelf support brackets may support rear and central transverse rails 28, as well as forward rail 30 which may include a product identification bracket 156.

Mounted upon the rails 28, 30 are individual product gravity feed and display units 32, separated from each other by dividers 34. Each of the gravity feed and display units is adapted to receive and support a plurality of products, such as the packaging 36 in FIGS. 6A and 6B, which are urged forwardly along the gravity feed and display unit to the front of the shelf, facilitating continual product identification and selection as the product stock is depleted.

Figure 2:
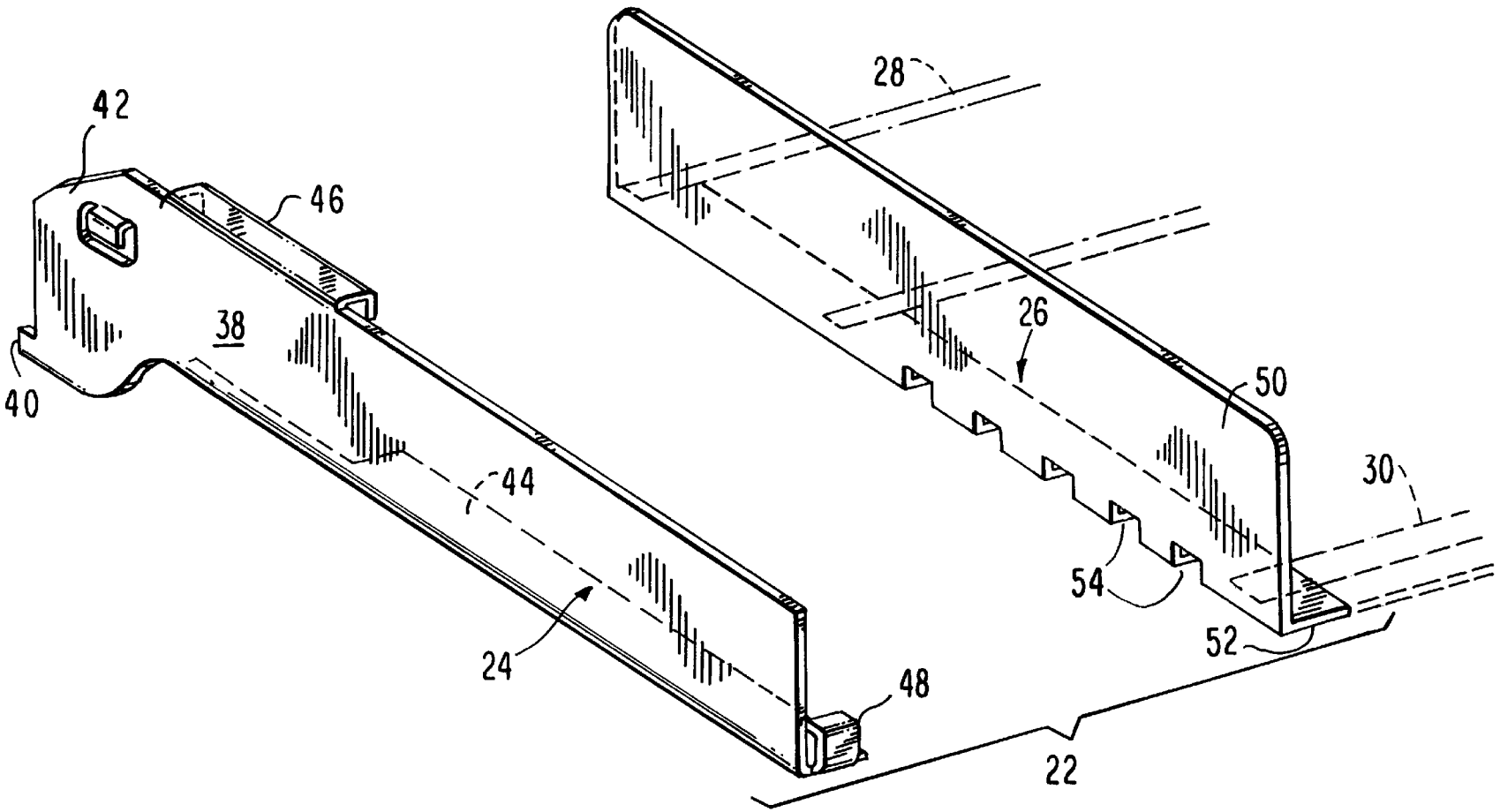
FIG. 2 is an exploded perspective view of the shelf bracket system thereof.

As depicted in FIG. 2, the mounting bracket 24 of bracket assembly 22 is of a general L-shaped construction, comprising main side wall 38 terminating at its rear edge with tab 40 adapted to mate with a chosen one of the second slots 18 on an upright 12. A second, L-shaped tab 42 extends outwardly and downwardly from the side wall proximate its rear edge, and is adapted to engage an upright 12 through a first slot 14. The combination of tabs 40 and 42 securely support the bracket assembly 22, and thus an entire shelf system 10 at the designated location within a store gondola. A horizontal ledge 44 projects from the lower edge of the forward portion of the main side wall and supports the shelf support bracket 26 thereon. An inwardly-directed L-shaped arm 46 is located at the rear upper edge of main side wall 38, and forms a channel to accept the top edge of the shelf support bracket. A locking tab 48 is located at the front of the horizontal ledge 44. The bracket is constructed such that the horizontal ledge 44 slopes downwardly at an angle of about 20 degrees from the horizontal where the brackets are installed on the gondola uprights. The downward angle develops a similar forward downward slant for the pusher tracks, allowing the pushers to urge the aligned products forwardly on the shelf.

Figure 11:
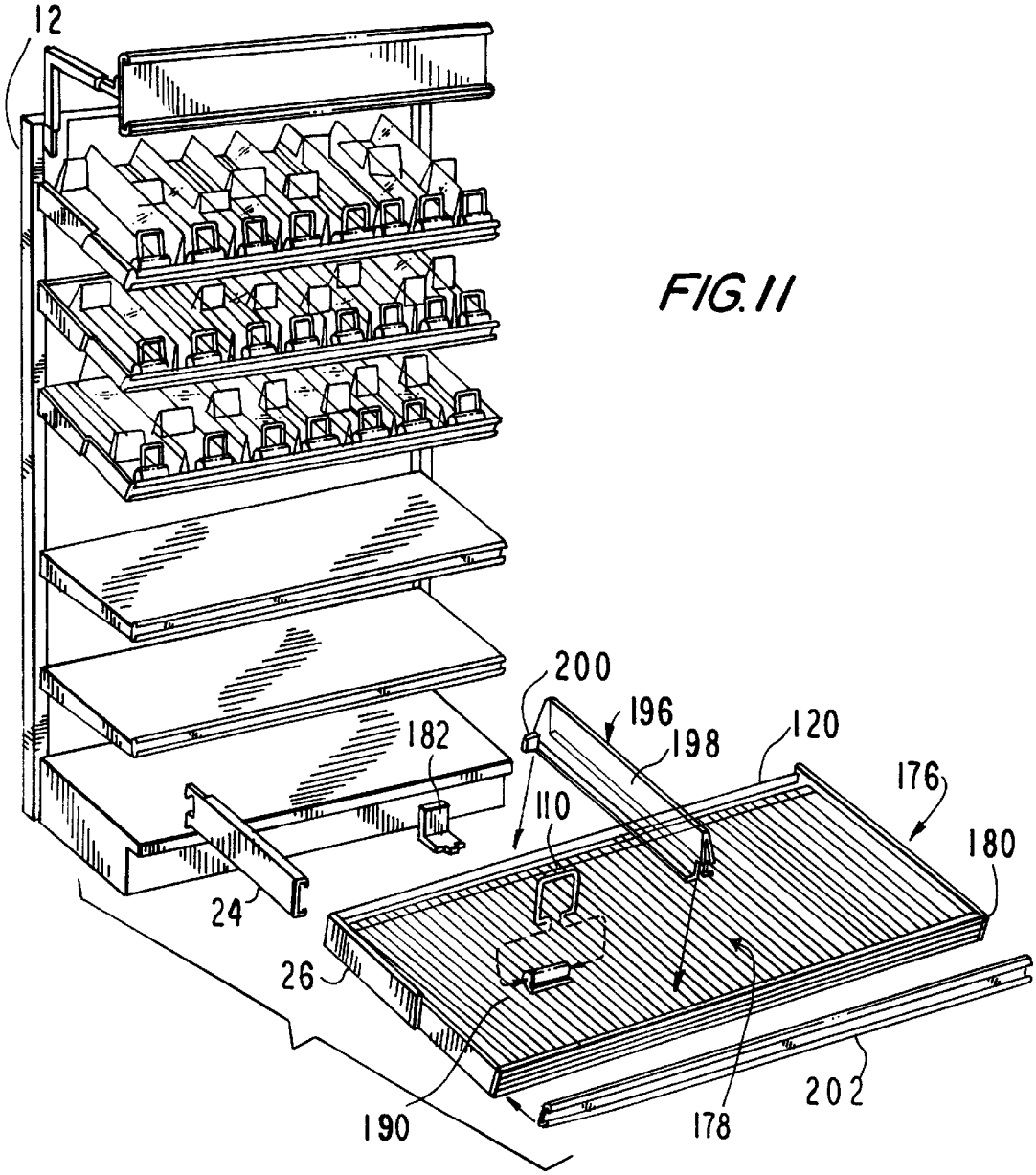
FIG. 11 is a perspective view of a shelf display system incorporating an alternative embodiment of the invention.

Shelf support bracket 26 is of similar L-shaped construction, with a main side wall 50 and horizontal ledge 52. The rails 28 and 30, shown in the drawing schematically and in phantom, may be welded to both the support bracket and the opposed shelf support bracket as seen in FIG. 1. Alternatively, a wire grid shelf construction, as shown in FIG. 11, can be supported by, and affixed to, the brackets. A series of slots 54 are arrayed along the lower corner of the shelf support bracket, and extend into both the side wall 50 and horizontal ledge 52, allowing the bracket 26, supported upon the horizontal ledge 44 of the mounting bracket 24 and gently embraced by top channel 46, to be adjustably extended as desired forward of the mounting bracket 24, the desired degree of extension being maintained by the locking effect resulting from the engagement of front tab 48 in a chosen slot 54. Adjustment may be performed by rotating or pivoting the mounting bracket out of slot retention by the tab 48, repositioning the mounting bracket as desired, and returning it to an engaged orientation.

Figure 3:
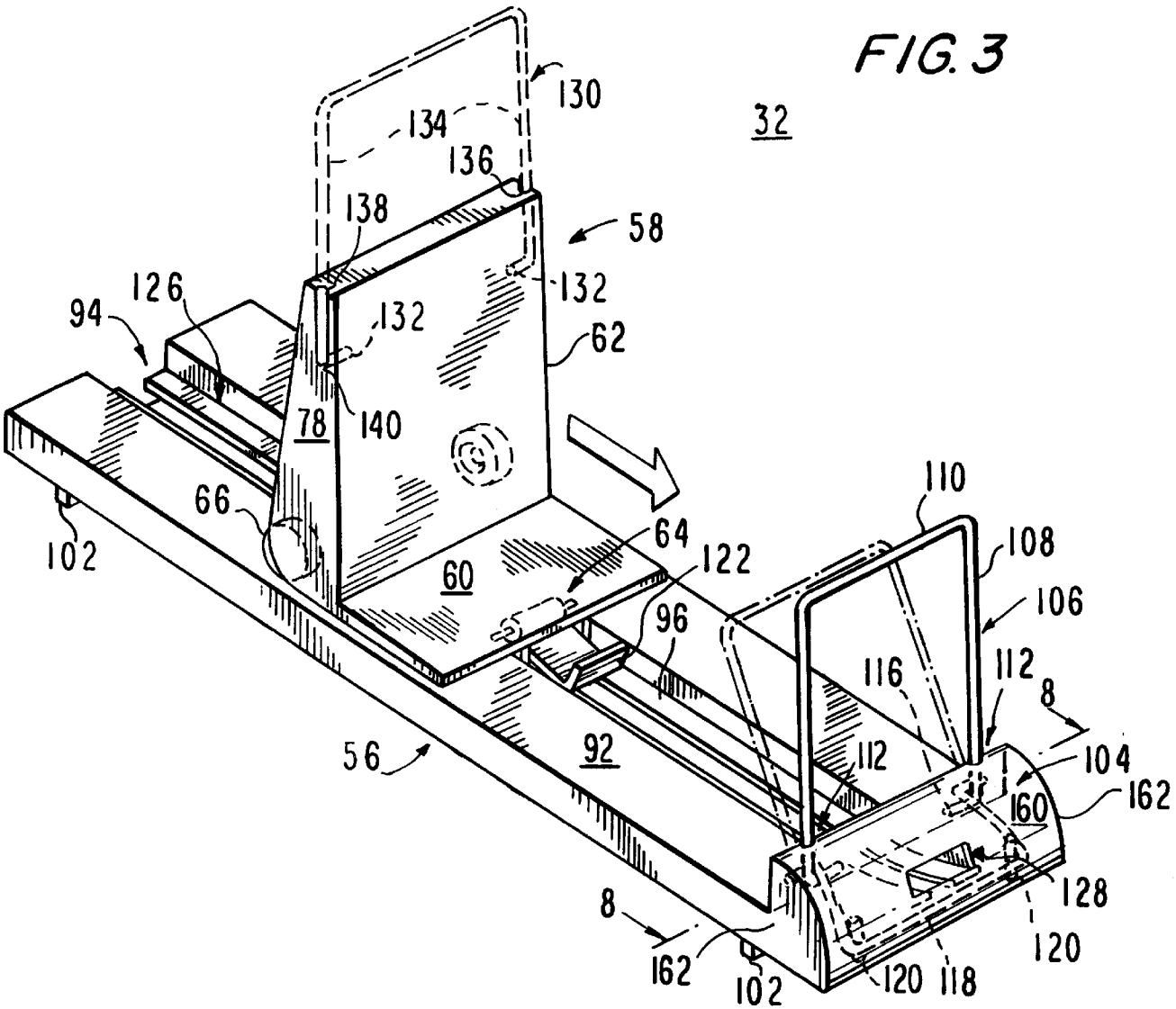
FIG. 3 is a perspective view of a gravity feed and display unit incorporating therein a pusher and product retainer bumper.
Figure 9:
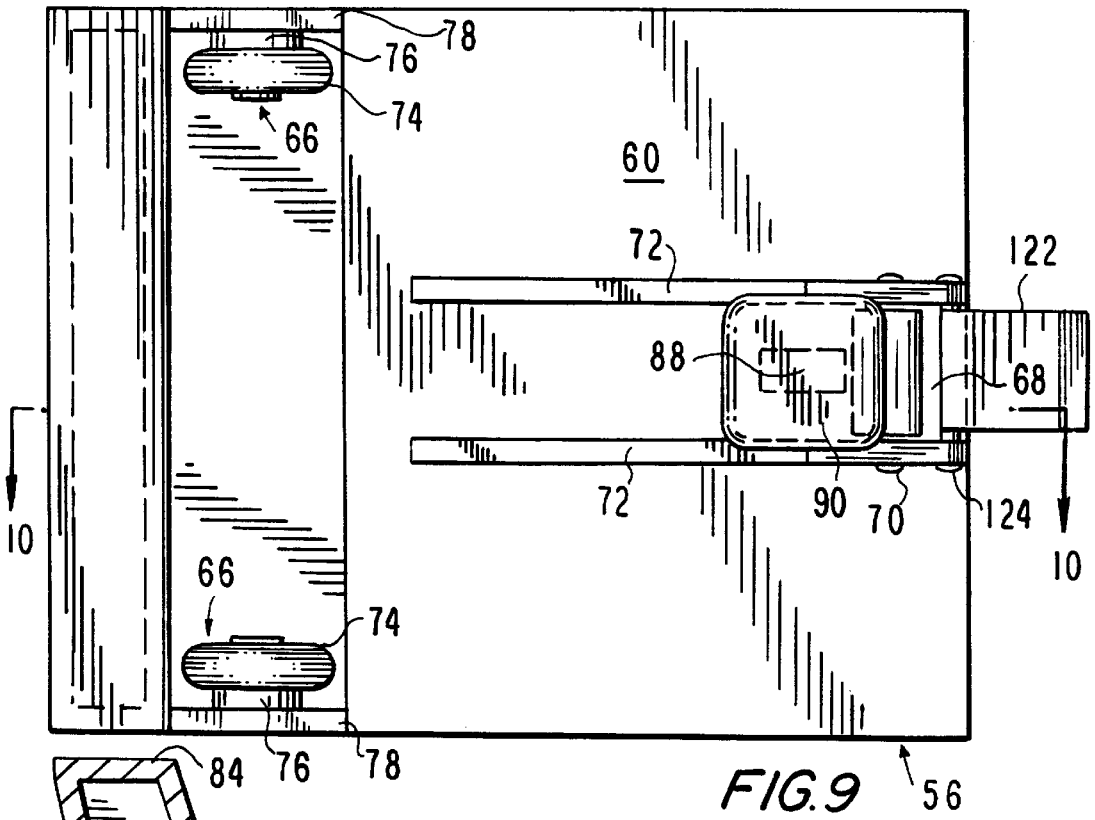
FIG. 9 is a bottom plan view of a pusher.
Figure 10:
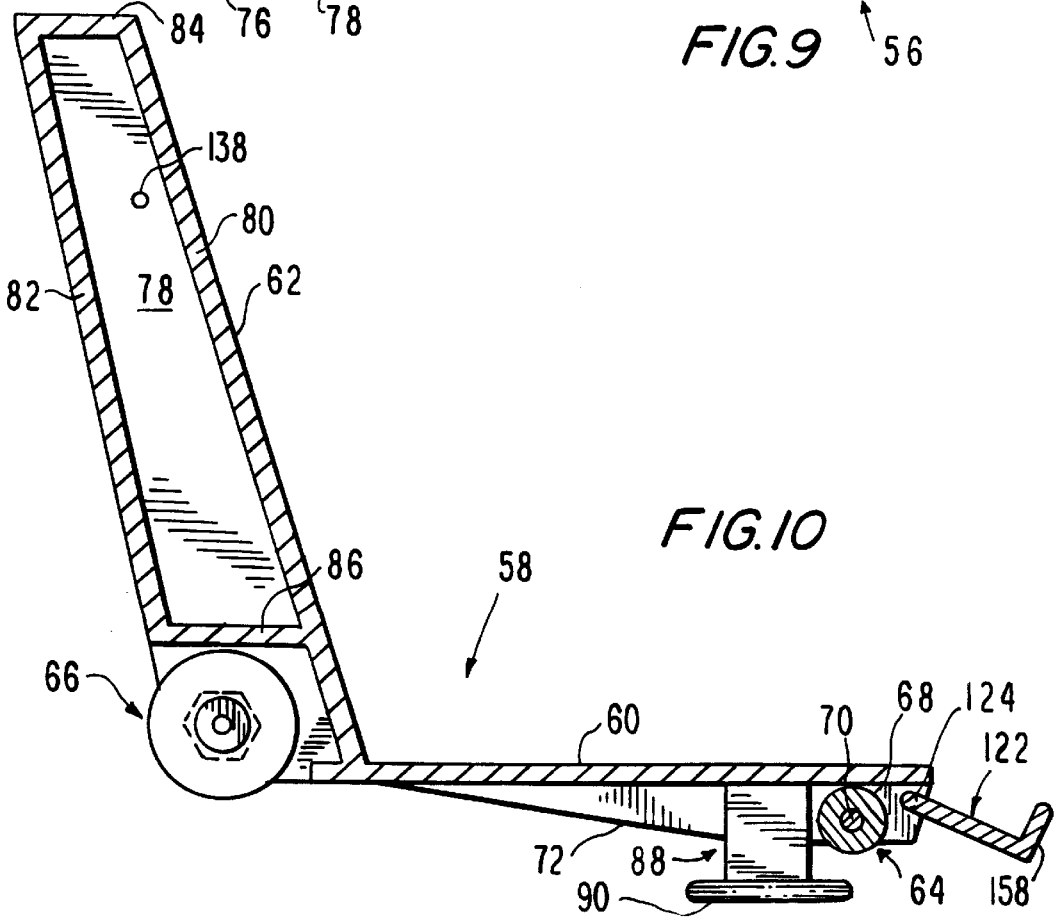
FIG. 10 is a side elevation view of a pusher in section taken along line 10—10 of FIG. 9.

Referring next to FIG. 3, gravity feed and display unit 32 comprises track 56 upon which product pusher 58 may be mounted for travel. As may be seen, pusher 58 is of generally L-shaped construction, having a forward horizontal product platform 60 and an upright pusher head 62. As further detailed in FIGS. 9 and 10, pusher 58, which may be formed of an appropriate high-density plastic or similar material as known in the art, is adapted to travel along the track 56 in a smooth manner by use of front and rear wheel assemblies 64, 66, respectively. Front wheel assembly 64 comprises roller 68 journaled for rotation upon axle 70, which in turn is supported by a pair of depending flanges 72 extending downwardly from product platform 60. Rear wheel assembly 66 comprises a pair of wheels 74, each of which is mounted to a stub axle 76 which extends inwardly from a side wall 78 of the pusher head 62.

The pusher head 62 may be formed with front and rear walls 80, 82, respectively, extending between the side walls 78 having top wall 84 and interior bottom wall 86. Bottom wall 86 is positioned above the lower end of front wall 80, rear wall 82 terminating at the bottom wall 86, thus allowing the lower portion of side walls 78 and front wall 80 to form a lower open cavity in which the rear wheel assembly 66 is located. A guide post 88 extends downwardly from product platform 60 and includes a pad 90 which engages a guide slot assembly in the track 56. The pusher platform accepts a series of the products, adding mass to the pusher to increase the force applied to the other arrayed products, and assisting in driving them forward.

The flanges 72 also support, at their front ends, restock indicator flag 122, which is pivotally mounted between the flanges by axle 124. The flag 122 is provided with indicator face portion 158 which may be painted a prominent color, and which, with the pusher in the full forward position resulting from arrayed product depletion, is observable by store personnel to facilitate restocking.

An extension bail 130 may be used in connection with pusher 58 to extend the height of the pusher head as may be required to accommodate and support tall products. As depicted in FIG. 3, the extension bail 130 is of a general U-shape, with vertical legs 134 terminating in a pair of inwardly-directed stub ends 132. The lower portions of the vertical legs 134 are accommodated in a pair of recesses 136 on the side walls 78 of the pusher head, the stub ends 132 extending inwardly through the side walls through bores 138 at the lower end of the grooves. When not required, the bail may be easily removed from the pusher head.

With reference next to FIGS. 7 and 8 in association with FIG. 3, track 56, which may be similarly formed of an appropriate high-impact plastic or other equivalent material, is of elongated construction, having a length appropriate for the shelf with which it is to be used, and has a top surface 92 upon which pusher rear wheel assembly 66 travels. A central guide slot construction 94 extends the length of the track and, as perhaps best seen in FIG. 7, includes a pair of opposed upper slot surfaces 96 adapted and located to support the front roller 68 of the pusher. The upper slot surfaces 96 are divided by central channel 98 which leads to lower horizontal chamber 100, adapted and dimensioned to capture and retain the pad 90 on pusher guide post 88. Four tabs 102 extend downwardly from the bottom surface of the base to engage dividers 34 as will be explained infra. The track is preferably formed by a molding process which imparts a textured finish to its top surface 92. Such a finish has been found to improve the ability of the pusher to travel thereon under the influence of gravity over a smooth surface finish.

Figure 6A:
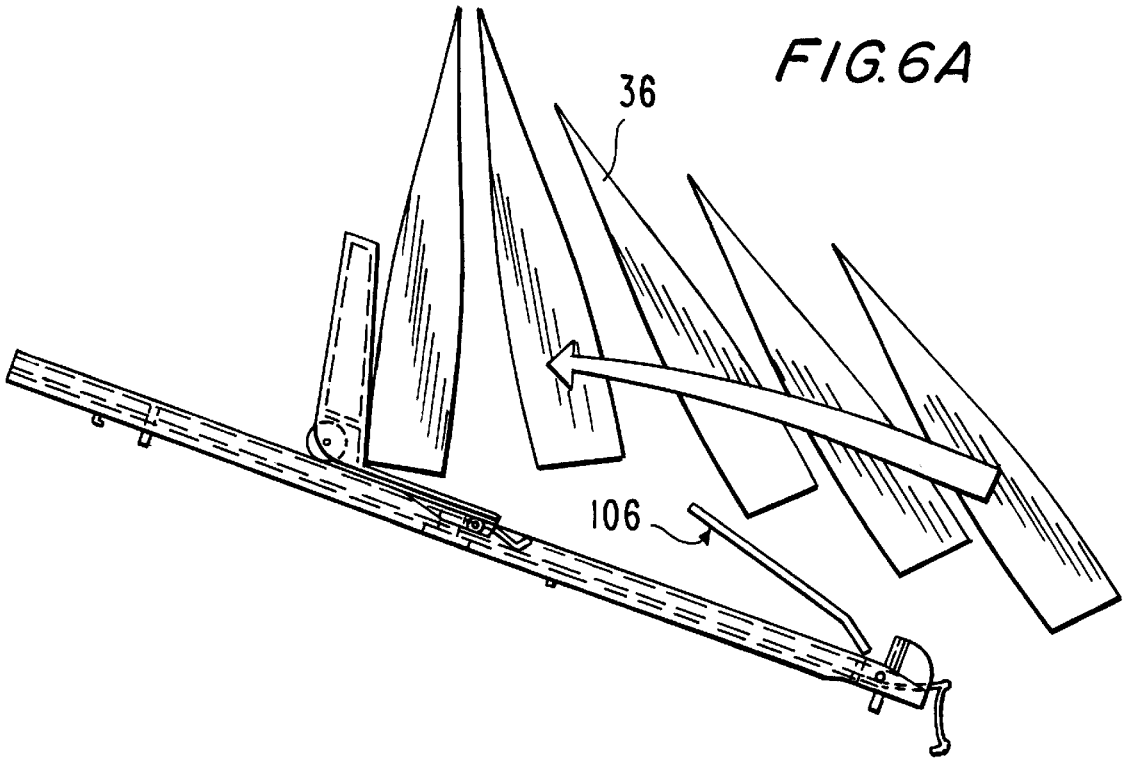
FIGS. 6A and 6B are illustrations of the loading of product onto a gravity feed and display unit.
Figure 6B:
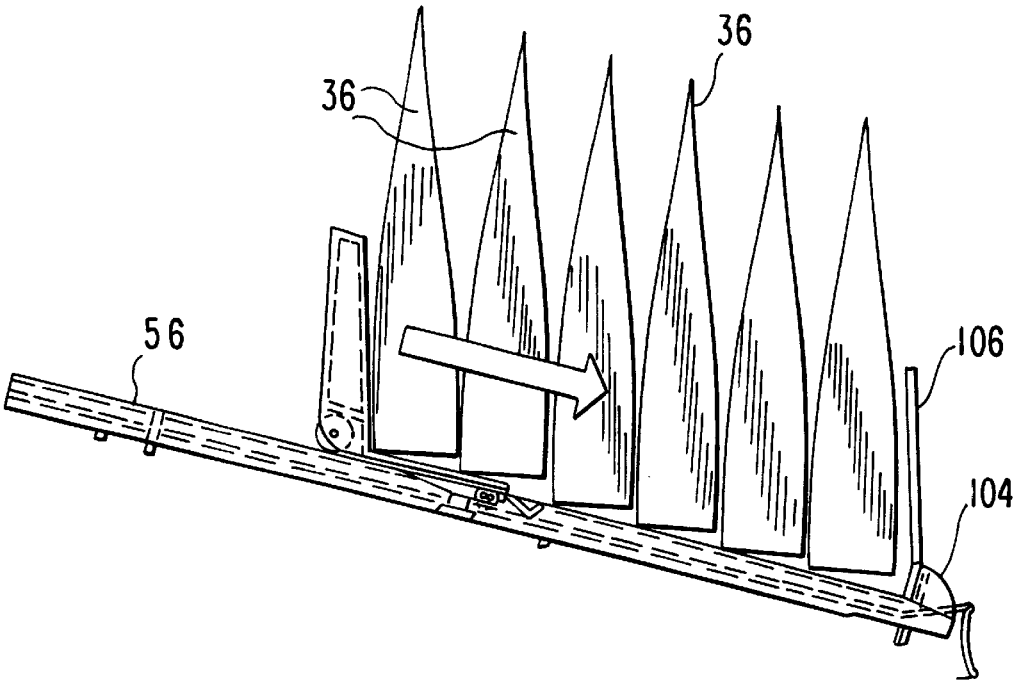

Product retainer bumper 104 may be formed as an integral part of the track 56 and, in association with bail 106, retains the arrayed products 36 on the track, as shown in FIG. 6B. As depicted in FIG. 3, bumper 104 may define the forward end of track 56, and includes vertical face 114 extending upward from track top surface 92. A curved top surface 160 extends forwardly and downwardly from the top edge of the face 114, while side walls 162 may be formed integral with the side walls of the track. The guide slot construction is upturned through the interior of the bumper, as seen in FIG. 3, such that the upper slot surfaces 96 terminate at the lower edge of rectangular window 128 in the bumper top surface 160. Accordingly, when the pusher arrives at the full forward position, the indicator flag 122, which rides on slot surfaces 96, is directed to and through the window 128. The flag is of a sufficient length such that so positioned, it extends beyond the forward end of the feed and display unit, easily perceived by store personnel, indicating a depleted shelf inventory for the stacked product and thus alerting the store personnel that restocking is required.

With particular reference to FIGS. 3 and 8, bail 106 is of generally U-shaped wire construction, having vertical side rails 108 and top horizontal rail 110. Alternatively, the bail may be of solid construction, comprising a clear plastic plate or the like. The lower portions of the side rails 108 are retained in vertical recesses 112 formed in the vertical face 114 of the bumper, the ends of the bail being bent inwardly at 116 under the track surface 92, forming a pivot axis for the bail as shown in FIG. 8. A resilient element 118, such as a spring wire or the like, may extend between the lower portions of the bail proximate its ends and a pair of internal pins 120 to provide a forwardly-directed bias or restoring force to the bail. Such a bias retains the bail in the full upright and vertical position as shown in FIG. 3, but allows the bail to be pivoted rearwardly, as shown in FIG. 6A, to facilitate access to the pusher 58 and the space between the pusher and the bail to allow product loading. As may be seen in FIG. 3, the indicator flag 122 of the pusher sits within the main recess 126 of the guide slot assembly. So oriented, the face portion 158 does not project above the top surface 92 of the track, and thus does not impede the stacking of products thereon.

Figure 4:
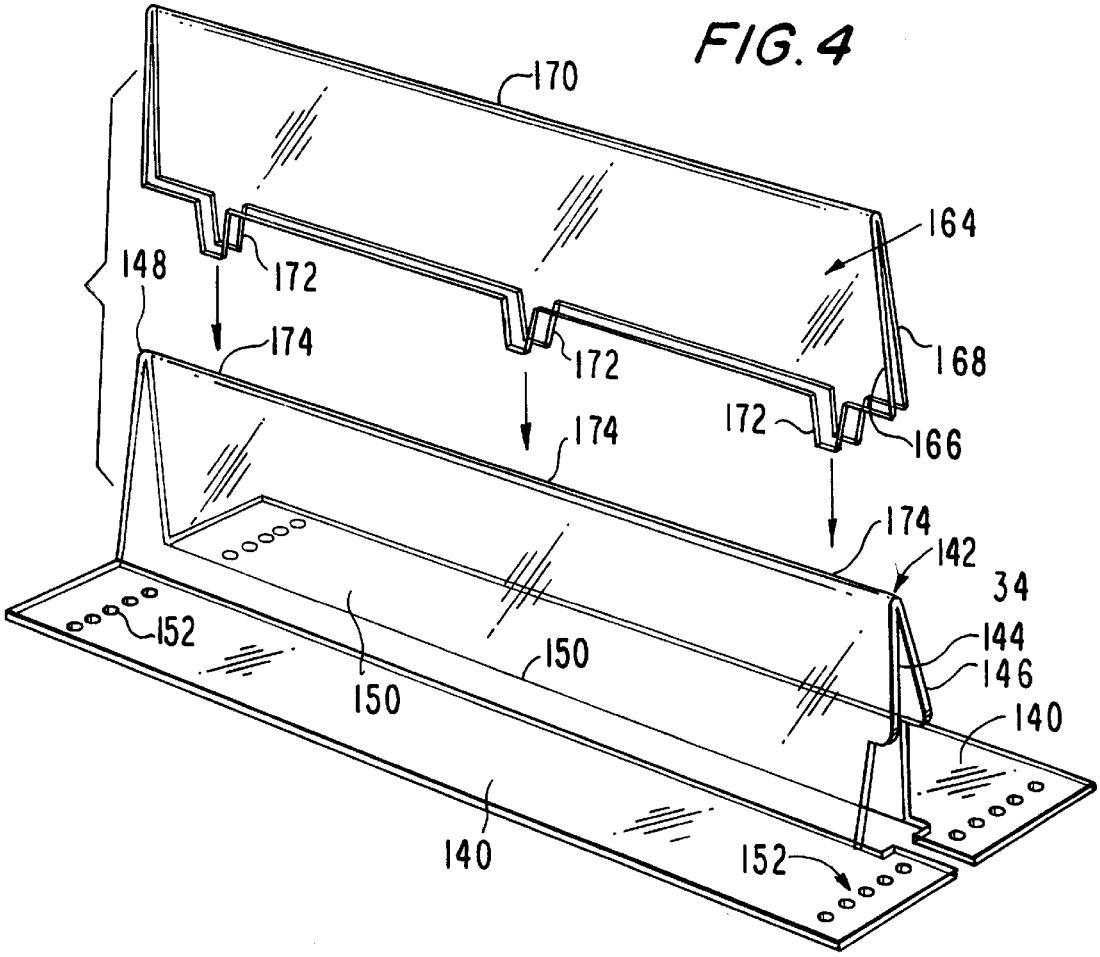
FIG. 4 is a perspective view of a divider.

Separation and alignment of the gravity feed units upon the shelf frame is performed by dividers 34, as detailed in FIG. 4. As depicted therein, a divider 34, which may be advantageously formed of transparent sheet plastic, includes a pair of generally rectangular base portions 140. Extending upwardly from the inwardly-directed and opposed edges of the bases is a folded vertical divider portion 142. When the divider is constructed of thin plastic as shown, both the base portions and the vertical divider portion may be formed from a single web of flat material. Score or fold lines may be provided at the lines of intersection between the portions to allow the web to be folded into the desired configuration.

Figure 5:
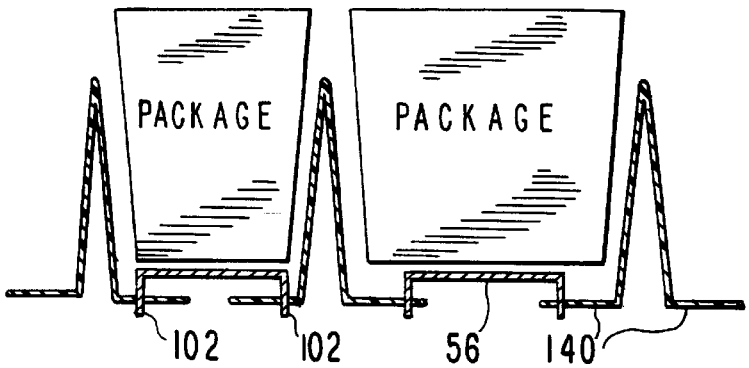
FIG. 5 is a schematic view depicting the relationship between dividers and gravity feed units.

Utilizing such a one-piece construction, the vertical divider portion 142 is composed of right and left wall portions joined at common upper edges by integral fold line 148. The wall portions are joined to the base portions 140 along fold lines 150. Each of the base portions 140 may be provided with rows of bores 152 adjacent the front and rear edges of the portions to accommodate the alignment tabs 102 on the gravity feed and display units. By choosing the proper set of bores, the spacing between the dividers, as depicted schematically in FIG. 5, can be adjusted as appropriate for the product supported on the feed and display units. As illustrated, differing spacing can be accommodated across the width of the shelf.

An extension panel 164 may be utilized in connection with the dividers to increase their height for use in connection with the presentation of tall products. The panel may similarly be constructed of die-cut sheet plastic, and may comprise right and left panels 166, 168 joined together at top edge fold line 170. To mount the extension panel upon the divider a series of integral mounting tabs 172 project from the lower edges of the panel. The tabs are retained in slots 174 located along the fold line 148 of the divider.

Figure 12:
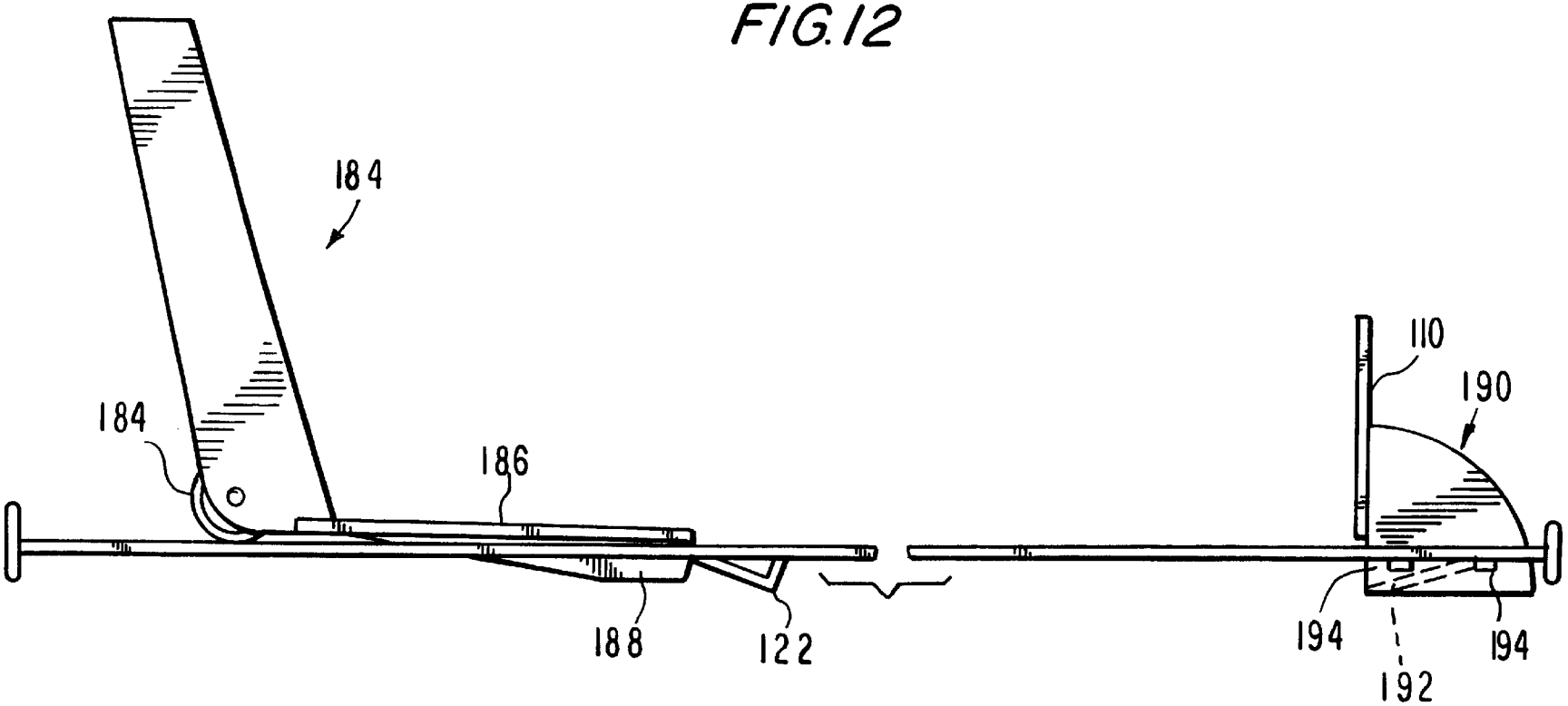
FIG. 12 is a detail side elevation view of the embodiment of FIG. 11.

As an alternative to a shelf construction in which feed and display units are supported on transverse shelf rails, the present invention also contemplates the use of pushers along a track which may be defined by a conventional wire grid shelf construction, as depicted in FIGS. 11 and 12. As shown therein, shelf panel 176 is formed of a plurality of grid wires 178 arrayed in a spaced parallel front-to-back configuration. The shelf panel 176 is mounted to the rail support brackets 26 which in turn interfit with mounting brackets 24 for installation upon gondola uprights 12. Front and rear transverse rails 180 may be provided between the brackets 26, the grid wires 178 being connected at their ends thereto. A front identification rail 202 can be mounted to the front rail.

Pusher 184 travels directly upon the grid wires 178. To facilitate such motion, the pusher may have roller-like rear wheel 184. Alternatively, a pair of spaced wheels can be used, positioned to ride upon corresponding grid wires. The forward end of the product platform 186 may rest directly upon the grid, the minimal contact between the platform and the grid wires minimizing the frictional resistance therebetween. Restock indicator flag 122 is pivotally mounted to depending flanges 188 positioned for orientation between an adjacent pair of grid wires, the flanges also serving to guide the pusher along the grid. As in the prior embodiment, the flag assumes a normal position between the grid wires so that it does not interfere with the products stacked upon and forward of the pusher. The grid wires are preferably coated with a paint or similar surfacing compound which provides a textured finish, improving the ease of travel of the pusher 184 thereon. A preferred paint is a urethane composition sold under the name WILD RICE by Herberts O'Brien Powder Products Inc. of Houston, TX.

Product retainer bumper 190 is mounted directly upon the shelf grid at the forward end of the shelf. It includes a window for flag 122 and is further provided with internal ramp 192 positioned between the grid wires bracketing the indicator flag, and which leads to the bottom edge of the window and which directs the indicator flag 122 upward for passage through the window when stacked product is depleted. The product retainer bumper may also include clips 194 to retain the bumper on the grid wires, and a bail 110, mounted for rearwardly pivoting to facilitate product loading.

In a similar fashion dividers 196 may be mounted to the shelf wires to separate and define the trackways for the pushers 182. The dividers, formed of an appropriate plastic, may comprise main vertical divider panel 198 and a pair of clips 200 located at the front and rear lower edge thereof to engage either the front and rear shelf rails 180, as shown, or the grid wires.

While the foregoing presents illustrative embodiments of the present invention, one skilled in the art can readily recognize that alternative ways of carrying out the invention can be achieved without departing from the scope thereof.

I claim:

1. An apparatus including uprights for the mounting of shelves for display and storage of packaged products in a store environment, comprising:

a shelf frame mountable to said uprights;

at least one gravity feed unit supported by said shelf frame in a forwardly-projecting position from said uprights, each of said gravity feed units having a track for acceptance of a plurality of packaged products arrayed in a serial arrangement between a front and rear end of said track, said track having a recess having a pair of slot surfaces and a lower chamber portion, the recess extending between the front and rear ends, being oriented with its front end being displaced downwardly from its rear end, and having a product retainer located at the front end of said track;

a pusher mounted upon said track for gravity-induced travel from said rear end to said front end, said pusher having a pusher face extending upwardly from said track for contact with a rearmost of said packaged products to maintain and deliver said product forwardly along said track to said front end and against said product retainer, a platform extending parallel to said track to accept packaged products thereon, at least one wheel mounted for rolling contact upon a top surface of said track, a guide wheel for rolling contact upon said slot surfaces within said recess and a guide post supporting a pad for retention with said lower chamber; and indicating means comprising a signal flag projecting forward from said pusher and resting in said recess below the top surface of the track as said pusher travels along the track and an aperture in said product retainer through which the signal flag projects for observation only when the pusher is at the front end of the track.

2. The apparatus of claim 1 wherein said flag is pivotally mounted to said pusher to rest upon the slot surfaces of said recess, said slot surfaces being curved upwardly through the product retainer to raise the flag as the flag passes through the product retainer.

3. The apparatus of claim 2 wherein said track has a textured surface.

4. The apparatus of claim 2 further comprising divider means located along first and second sides of said track to prevent side-to-side movement of said packaged products.

5. The apparatus of claim 4, wherein said divider means rest upon said shelf frame.

6. The apparatus of claim 4, wherein said shelf frame comprises a pair of brackets mounted to said uprights and a plurality of spaced rails extending between said brackets.

7. The apparatus of claim 6, wherein said brackets are of adjustable length.

8. The apparatus of claim 6, wherein said divider means rest upon said rails.

9. The apparatus of claim 8, wherein said divider means include a base portion to rest upon said rails and a vertical divider portion.

10. The apparatus of claim 9, wherein said base portion of said divider and said track include means to interconnect said divider to said track.

11. The apparatus of claim 10, wherein said interconnect means comprise bores in said base portion and tabs on said track.

12. The apparatus of claim 1, 2 or 3, wherein said product retainer includes an upwardly-extending product retention bail.

13. The apparatus of claim 12, wherein said pusher face includes a removable bail projecting upwardly therefrom.

14. The apparatus of claim 12, wherein said bail is pivotable between an upright and a lowered position.

15. The apparatus of claim 14, wherein said bail is resiliently biased into the upright position.

16. An apparatus for display and storage of packaged products, comprising:

a shelf having a track having a surface extending forwardly along said shelf, said shelf being inclined downwardly from back to front;

a pusher positioned upon said surface of said shelf for gravity-induced travel from a rear end of said shelf to a front end of the shelf along said track, said pusher having a pusher face extending upwardly for contact with a rearmost of said packaged products to maintain and deliver said products forwardly along said shelf and a platform extending parallel to said track to accept packaged products thereon; and at least one wheel mounted for rolling contact upon said surface of the track;

a product retainer located at a forward end of said track, said product retainer having an upstanding wall for contact with a frontmost of said packaged products; and indicating means comprising a signal flag pivotally mounted to said pusher, projecting forward from said pusher and having a position below the top surface of the track as said pusher travels along the track, and a upwardly curved aperture through said product retainer to guide the signal flag to an elevated position extending and projecting through the product retainer for observation only when the pusher is at the front end of the track.

17. The apparatus of claim 16, wherein said shelf includes adjustable length brackets for mounting said shelf upon uprights.

18. The apparatus of claim 16 further comprising divider means along first and second sides of said track to prevent side-to-side movement of said packaged products.

19. The apparatus of claim 18, wherein said divider means rest upon said shelf frame.

20. The apparatus of claim 16, wherein said track is formed from a series of wire elements having a textured surface extending between the front and rear ends of the shelf.

21. The apparatus of claim 20, wherein said pusher includes a guide for travel between an adjacent pair of said wire elements, said signal flag being pivotally mounted to said guide.

22. The apparatus of claim 20, wherein said textured surface is in the form of a coating upon the wire elements.

23. The apparatus of claim 22, wherein said coating is a paint.

24. The apparatus of claim 16, wherein said product retainer includes an upwardly-extending product retention bail.

25. The apparatus of claim 16 or 24, wherein said pusher face includes a retractable bail projecting upwardly therefrom.

26. The apparatus of claim 24, wherein said product retention bail is pivotable between an upright and a lowered position.

27. The apparatus of claim 26, wherein said bail is resiliently biased into the upright position.

* * * * *